US005121573A

United States Patent [19]

Vassena

[11] Patent Number: 5,121,573

[45] Date of Patent: Jun. 16, 1992

[54] WIRE CLEANING APPARATUS AND SYSTEM

[75] Inventor: Giuseppe Vassena, Malgrate, Italy

[73] Assignee: Florida Wire and Cable Company, Jacksonville, Fla.

[21] Appl. No.: 522,268

[22] Filed: May 10, 1990

[30] Foreign Application Priority Data

Jun. 2, 1989 [IT] Italy ..... 20745 A/89

[51] Int. Cl.[5] ..... B24B 23/06

[52] U.S. Cl. ..... 51/149; 51/DIG. 10; 51/156

[58] Field of Search ..... 51/149, DIG. 10, 156, 51/150

[56] References Cited

U.S. PATENT DOCUMENTS

| | | | |
|---|---|---|---|
| 762,180 | 6/1904 | Michou | 51/DIG. 10 |
| 1,243,837 | 8/1917 | Heinauer | 51/DIG. 10 |
| 1,265,339 | 5/1918 | Jones . | |
| 1,728,622 | 9/1929 | Mascych . | |
| 2,275,563 | 3/1942 | Sharlow | 15/97 |
| 2,284,904 | 7/1942 | Illmer et al. | 51/150 |
| 2,320,173 | 5/1943 | Cotton | 15/40 |
| 2,329,376 | 9/1943 | Illmer et al. | 205/21 |
| 3,117,401 | 1/1964 | Talley | 51/241 |
| 3,702,489 | 11/1972 | Nakamura et al. | 15/88 |
| 3,780,552 | 12/1973 | Staskiewicz et al. | 72/40 |
| 3,976,815 | 8/1976 | Brekle | 427/292 |
| 4,286,449 | 9/1981 | Spreafico | 72/40 |
| 4,391,016 | 7/1983 | Kawamura et al. | 15/302 |
| 4,977,707 | 12/1990 | Chachin et al. | 51/DIG. 10 |

*Primary Examiner*—Bruce M. Kisliuk
*Assistant Examiner*—Larence Cruz
*Attorney, Agent, or Firm*—Ira S. Dorman

[57] ABSTRACT

Apparatus, for in-line cleaning of wire being formed, disposes abrasive elements in confronting relationships on opposite sides of the travel path and in surface contact with the wire running between them.

19 Claims, 3 Drawing Sheets

WIRE CLEANING APPARATUS AND SYSTEM

BACKGROUND OF THE INVENTION

The present invention provides apparatus for the inline abrasive cleaning and polishing of metal wire and the like, fabricated in cold drawing or cold rolling operations.

Lubricants, lubricant carriers, and other substances utilized in cold drawing and cold rolling of metal normally produce residues, the removal of which is usually necessary before the product can be employed for ultimate purposes. It is conventional to utilize solvent-, steam-, electrolytic- or acid-degreasing techniques to effect the removal of such residues, but such techniques are often inconvenient, expensive and relatively inefficient; moreover, waste streams produced will generally necessitate further processing, and may give rise to disposal requirements that are difficult and expensive to satisfy.

Jones U.S. Pat. No. 1,265,339 employs stationary, emery paper-covered cleaning blocks, mounted in face-to-face relationship and spring loaded to bear upon the opposite sides of a steel tape drawn between them.

Mascuch U.S. Pat. No. 1,728,622 utilizes confronting pairs of abrasive wheels spaced from one another, on mutually perpendicular axes, along the path of movement of the bar being ground.

Sharlow U.S. Pat. No. 2,275,563, issued Mar. 10, 1942, discloses apparatus that employs confronting, oppositely disposed rollers for straightening wire and for disintegrating surface deposits; applied solvent is removed by a rubber element in a wiping gland.

U.S. Pat. Nos. 2,320,173 to Cotton and 3,780,552 to Staskiewicz et al both show two pairs of confronting elements spaced from one another along, and disposed on mutually perpendicular axes relative to, the workpiece travel path.

Illmer et al U.S. Pat. No. 2,329,376 (a continuation of No. 2,284,904) discloses a wire-making process utilizing an arrangement (shown in most detail in FIGS. 4 and 5) for abrasively cleaning and polishing the wire in-line. The cleaning mechanism consists of pairs of confronting jaws, over which abrasive-coated strips are slowly advanced in contact with the moving wire, under fluid pressure applied to one of the jaws. It employs multiple pairs of axially spaced jaws, arranged at different orientations about the axis of the wire so as to abrade and polish the entire profile..

Talley U.S. Pat. No. 3,117,401 provides apparatus that incorporates abrasive blocks for polishing and finishing a concrete column; substantially rectangular blocks are preferred.

In accordance with Nakamura et al U.S. Pat. No. 3,702,489, issued Nov. 14, 1972, a set of three offset and canted wire brushing wheels are employed for mechanically removing scale from hot rolled wire material.

Breckle U.S. Pat. No. 3,976,815, issued Aug. 24, 1976, utilizes a pair of abrasive-surfaced, resilient pneumatic drums for cleaning rod stock; the drums rotate about their own axes, as well as orbiting the axis of the rod.

Pairs of biased brushes are employed in the machine of Speafico U.S. Pat. No. 4,286,449, issued Sep. 1, 1981, for cleaning Wires; the brushes of each pair are axially offset from one another, With sequential pairs operating in horizontal and vertical planes.

Kawamura et al U.S. Pat. No. 4,391,016, issued Jul. 5, 1983, provides degreasing apparatus for rod stock, which utilizes at least one pair of rotating brushes for surface cleaning; the brushes are disposed in direct opposition, on an axis perpendicular to that of the wire.

Despite the activity in the art indicated by the foregoing, a need remains for a relatively simple and inexpensive apparatus and system for the abrasive cleaning and polishing of metal wire and the like, which apparatus and system are suitable for in-line use with cold-drawing and cold-rolling operations, and present only a minor amount of restriction to movement while maintaining constant levels of cleaning and polishing efficiency. Accordingly, the broad objects of the present invention are to provide a novel and practical apparatus having the foregoing features and advantages, and to provide a novel system incorporating the same.

More specific objects of the invention are to provide such an apparatus in which the buffers utilized can be precisely and easily adjusted, in which the usable life of the buffer elements can readily and substantially be extended, and which may be a self-contained device adapted for ready installation into a system for the production of wire and other continuous-length workpieces.

SUMMARY OF THE INVENTION

It has now been found that certain of the foregoing and related objects of the present invention are attained by the provision of apparatus comprising a housing, or casing, having means defining therethrough an axial travel path, mounting means operatively attached to the housing, and at least one pair of stationary buffers. The mounting means disposes the buffers on a common axis, which is perpendicular to the travel path through the housing, and each of the buffers includes an element that has an end face made of an abrasive material. The end faces of the buffers are disposed in confronting relationship to one another, on opposite sides of the travel path.

The apparatus will generally include at least two pairs of the buffers, the elements of each pair being disposed on a common axis associated with that pair, with the mounting means spacing the buffer pairs from one another along the travel path through the housing. At least one buffer pair will preferably be disposed with its common axis perpendicular to the common axis of another such pair. Most desirably, the apparatus will include at least four pairs of buffers, the pairs being spaced from one another along the travel path and being disposed with their common axes alternating and mutually perpendicular to one another.

The mounting means will usually include a support for each of the buffer elements. A preferred form of the apparatus will include at least two mounting plates, disposed within the housing on opposite sides of the travel path, and most desirably there will be four such plates spaced at 90° intervals from one another about the travel path. Each of the plates will mount the support for one buffer of two separate pairs thereof (the pairs thus being disposed with their associated common axes parallel to one another), thereby facilitating precise adjustment of the buffer elements with respect to the travel path. Generally, the apparatus will include means for biasing such mounting plates toward one another.

The housing of the apparatus will preferably be elongated, and will include a guide element, supported by a plate or other member at each of its opposite ends, for cooperatively defining the axis of movement of a workpiece along the travel path therethrough; the end plates will advantageously be assembled with a number of bars extending longitudinally between them. In such form, the apparatus may constitute a self-contained device, adapted for installation into a system for producing wire or the like.

The flat end faces of the buffer elements will most desirably be disposed substantially perpendicularly to the common axis on which the elements are mounted, and the mounting means will be adapted to permit positioning of each of the buffer elements in either of least two orientations rotated thereabout; this may be accomplished simply by making the buffer elements removable from their associated supports. The common axis on which the buffer elements are disposed will lie in a non-intersecting relationship to the axis of movement of the workpiece, thereby causing the workpiece, in one of the orientations of the buffer elements, to traverse a line across the end faces thereof which is different from the line that is traversed in the other orientation of the elements. Generally, the two lines traversed by the workpiece will be parallel to one another, and offset by an equal distance from the common axis of mounting of the buffer elements. In particularly desirable embodiments, the abrasive material of which the buffer elements are made will comprise rubber and a relatively soft abrasive. The abrasive substance may be a boron carbide material.

Other objects of the invention are provided by a system for the processing of wire and the like. It includes, in addition to the abrasive cleaning apparatus hereinabove described, means for producing a continuous-length workpiece having a surface deposit upon it, and means for taking up the workpiece after passing through the cleaning apparatus.

DETAILED DESCRIPTION OF THE ILLUSTRATED EMBODIMENTS

Figure 1:
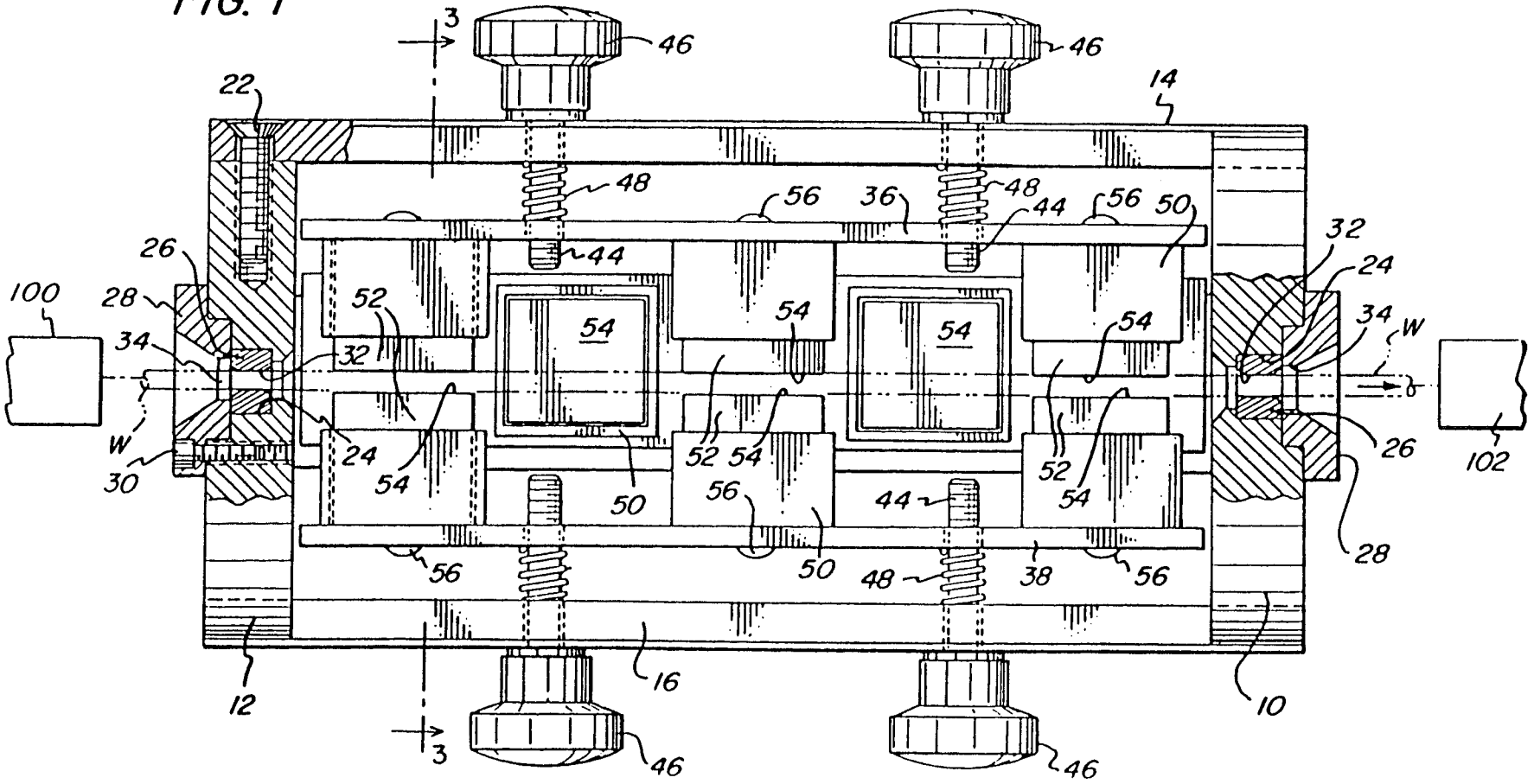
FIG. 1 is a diagrammatic illustration of the system hereof, showing in elevation the apparatus of the invention, with portions of the housing thereof broken away to expose internal features.
Figure 2:
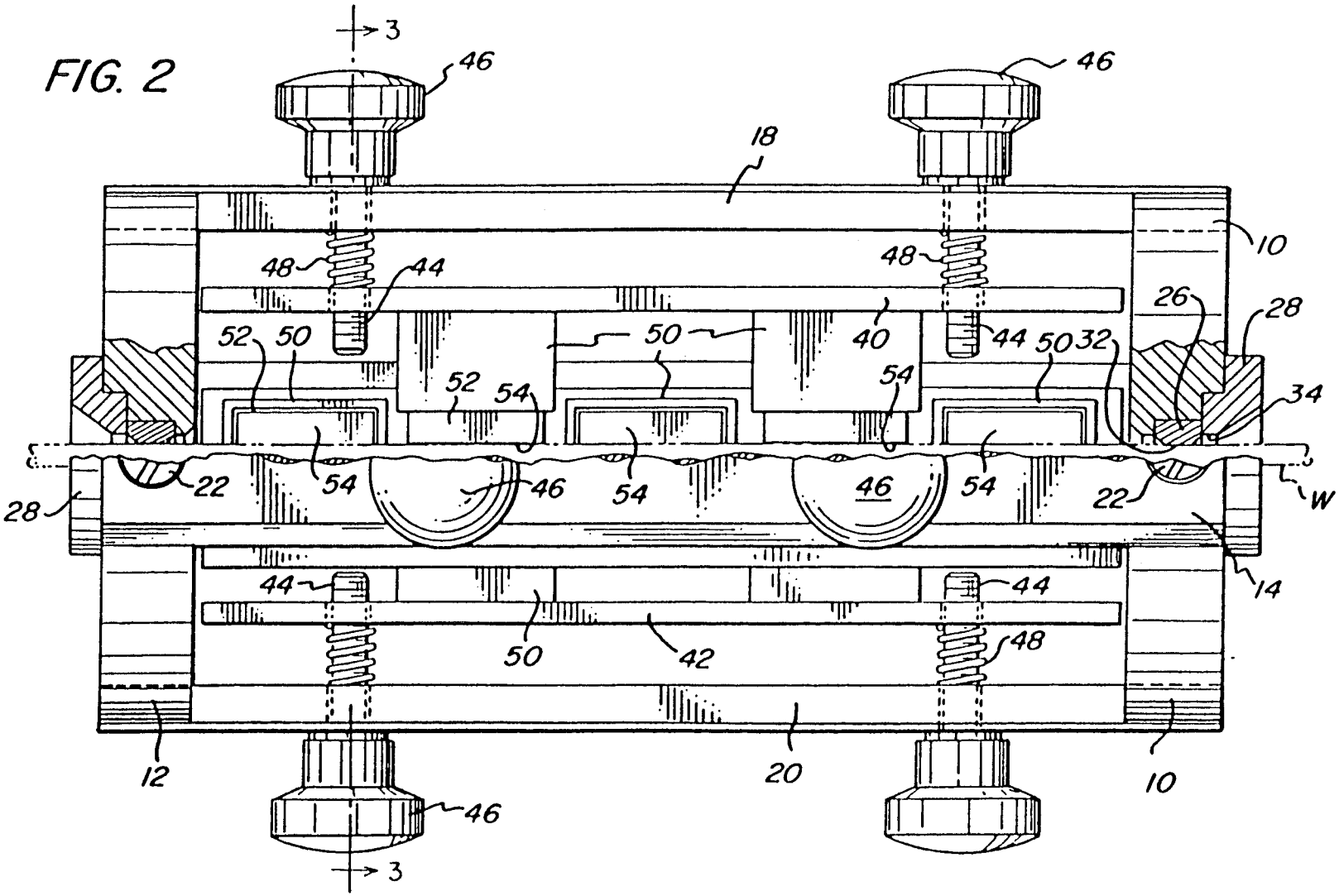
FIG. 2 is a plan view of the apparatus (i.e., a view rotated 90°, about the longitudinal axis, from the orientation of FIG. 1), also having housing sections broken away.
Figure 4:
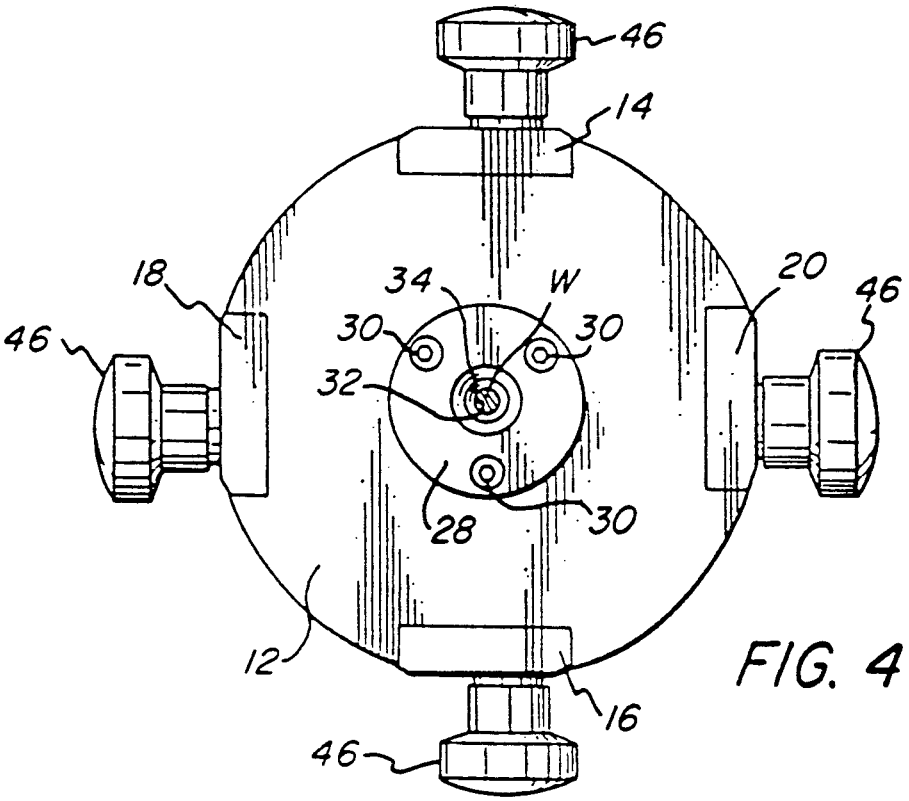
FIG. 4 is a view of the apparatus taken from the left end, as depicted in FIGS. 1 and 2.

Turning now in detail to the appended drawings, therein illustrated is the system and apparatus of the present invention. The apparatus consists of an elongated housing or casing including opposite end pieces or plates 10, 12, between which extend longitudinally, and at equiangularly (90°) spaced locations thereabout, four parallel posts or bars 14, 16, 18 and 20, the bars being attached at their opposite ends to the pieces 10, 12 by screws 22. Axially aligned compound openings 24, extending through the end pieces 10, 12, serve to seat guide bushings 26 and terminal heads 28, the latter being affixed in place upon the associated end piece by three screws 30. The bushings 26 and terminal heads 28 have apertures 32, 34, respectively, extending through them, which are coaxial with the openings 24 and thereby cooperate to define an axial travel path through the housing.

Four elongated mounting plates 36, 38, 40 and 42 are disposed within the housing, each being mounted upon one of the bars 14, 16, 18, 20 by a pair of adjustable mounting knobs, the latter consisting of a threaded shank portion 44 and an attached head 46. A coil spring 48 on the shank portion 44 of each mounting knob is interposed between the associated plate and the bar, the springs thus serving to urge the plates inwardly toward one another from opposite sides of the casing.

Three supports 50, of square cross section, are provided on each of the plates 36 and 38 at spaced locations along the length of the apparatus, and two such supports 50 are provided on the plates 40 and 42 at locations intermediate those on the plates 36 and 38. A cubic buffer element 52 is seated within each support 50, and is removably secured therein with a screw 56. Thus, the buffer elements 52 are supported on opposing plates, paired as 36 and 38, and 40 and 42, respectively; the elements 52 are disposed with their flat surfaces 54 in confronting relationship to one another, and they are also aligned as pairs on common associated axes. Such axes are perpendicular to the longitudinal axis through the casing and are also perpendicular to one another, in alternating positions along the travel path.

As can be seen, the flat faces 54 of the buffer elements 52 are in direct contact with the workpiece "W," which may be a wire transported from the forming unit 100, along the travel path through the cleaning device and taken up by the unit 102. The stationary buffer elements, made from an abrasive-filled rubbery material, therefore wipe the surfaces of the workpiece "W" as it is conveyed along the travel path, thereby cleaning and polishing it.

Figure 3:
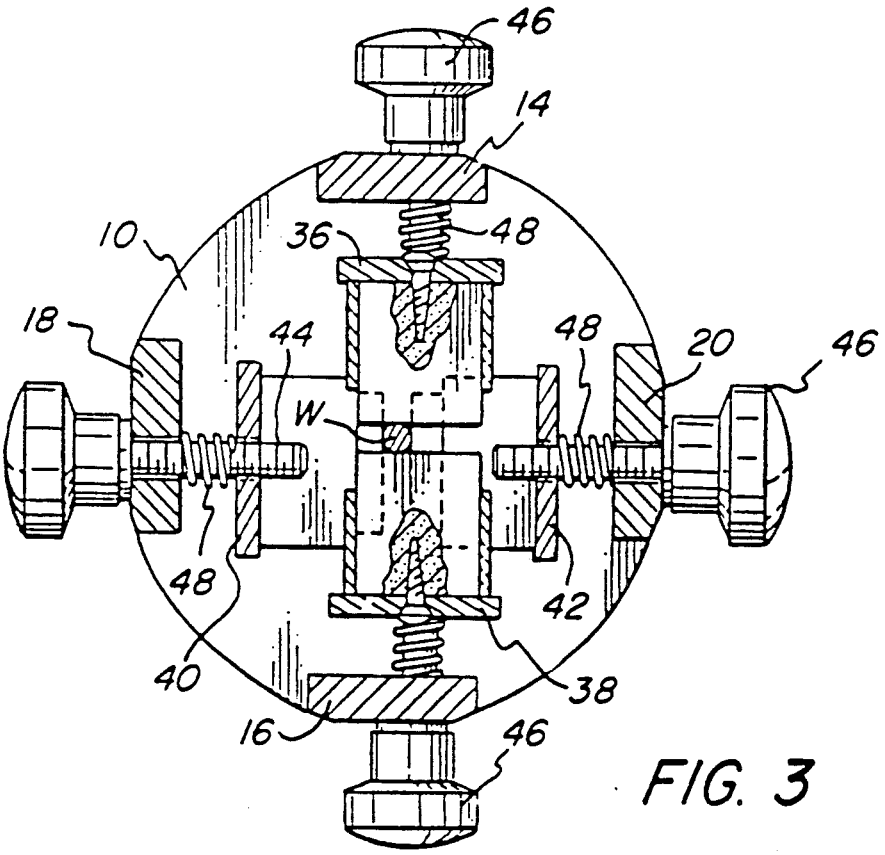
FIG. 3 is a sectional view of the apparatus taken along lines 3—3 of FIG. 1, showing a wire workpiece passing therethrough.

As can also be seen (note FIGS. 1 and 3 in particular), the supports 50 are so positioned, relative to the travel path axis defined by the guide bushings 26 in the opposite end pieces 10, 12, as to offset their common axes in a non-intersecting orientation with the travel path axis. The workpiece "W" therefore traverses each flat face 54 along a line that is displaced from a line across the center of the face. Fresh portions of the faces 54 can therefore be presented to the workpiece by removing the buffer elements from their supports 50 and rotating them by 180°, causing the workpiece to traverse the faces on a line that is parallel to the line originally traversed; the buffer elements may also be reoriented to present their other faces to the workpiece.

Because the apparatus employs pairs of buffers, aligned along common axes perpendicular to the direction of movement of the workpiece, and because the axes of sequential pairs of buffers alternate with one another, the cleaning effect is highly efficient and the buffers cooperate in providing a guide for the workpiece, maintaining it in a rectilinear condition. Also, because two or more of the buffer elements are attached to a single mounting plate, they are adjusted simultaneously and, therefore, with desirable facility and precision.

Thus, it can be seen that the present invention provides a relatively simple and inexpensive apparatus and system, for in-line use with cold-drawing and cold-rolling operations, which present only a minor amount of restriction to movement while maintaining constant levels of cleaning and polishing efficiency. The buffers utilized in the apparatus can be precisely and easily adjusted, and the usable life of the buffer elements can be extended readily and substantially. In addition, the apparatus provides a self-contained device, adapted for installation into a system for the production of wire and other continuous-length workpieces.

Having thus described the invention, what is CLAIMED is:

1. Apparatus for the abrasive cleaning and polishing of metal wire and the like, comprising a housing having means defining an axial travel path therethrough, mounting means, and at least two pairs of stationary buffers, each of said buffers including a removable element having a flat end face made of an abrasive material; said mounting means being operatively attached to said housing and disposing said buffers of each of said pairs on an associated common axis, said common axes being parallel to one another, perpendicular to said travel path, and spaced from one another therealong, said mounting means also being adapted to permit selective positioning of each of said buffer elements in either of at least two fixed orientations rotated about said associated common axis, and including a support for each of said buffer elements and at least two mounting plates disposed within said housing on opposite sides of said travel path, each of said plates mounting said support for one buffer element of both of said pairs; said end faces of said elements of each pair of buffers lying substantially perpendicular to said associated common axis, and being disposed in confronting relationship to one another on opposite sides of said travel path; said housing having end members at the opposite ends thereof, each of said end members having a guide element therein for cooperatively defining the axis of movement of a workpiece along said travel path, said common axes being non-intersecting with said axis of movement so as to thereby cause said axis of movement to traverse said end face of each of said buffer elements along a line in one of said orientations thereof which is different from the line traversed thereacross in the other of said buffer element orientations.

2. Apparatus for the abrasive cleaning and polishing of metal wire and the like, comprising a housing having means defining an axial travel path therethrough, mounting means, and at least one pair of stationary buffers, each of said buffers including a removable element having a flat end face made of an abrasive material; said mounting means being operatively attached to said housing and disposing said buffers on an associated common axis perpendicular to said travel path, said mounting means also being adapted to permit selective positioning of each of said buffer elements in either of at least two fixed orientations rotated about said associated common axis; said end faces of said buffer elements lying substantially perpendicular to said associated common axis, and being disposed in confronting relationship to one another on opposite sides of said travel path; said housing having end members at the opposite ends thereof, each of said end members having a guide element therein for cooperatively defining the axis of movement of a workpiece along said travel path, said common axis being non-intersecting with said axis of movement so as to thereby cause said axis of movement to traverse said end face of each of said buffer elements along a line in one of said orientations thereof which is different from the line traversed thereacross in the other of said buffer element orientations.

3. The apparatus of claim 2 wherein said apparatus includes at least two of said pair of buffers, said mounting means spacing said buffer pairs from one another along said travel path.

4. The apparatus of claim 3 wherein one of said buffer pairs is disposed with said common axis thereof perpendicular to said common axis of the other of said buffer pairs.

5. The apparatus of claim 2 wherein said apparatus is a self-contained device adapted for installation into a system for the production of wire and the like.

6. The apparatus of claim 5 wherein said housing is elongated, wherein said end members are plates, and wherein said housing additionally includes a plurality of bars attached adjacent opposite ends thereof to said plates and extending therebetween to space said plates longitudinally from one another.

7. The apparatus of claim 2 wherein said abrasive material of which said buffer elements are made comprises rubber and a relatively soft abrasive.

8. The apparatus of claim 7 wherein said abrasive is boron carbide.

9. The apparatus of claim 2 wherein said buffer elements are of cubic form, and wherein said selective positioning is effected with removal of said buffer elements from said mounting means.

10. Apparatus for the abrasive cleaning and polishing of metal wire and the like, comprising a housing having means defining an axial travel path therethrough, mounting means, and at least one pair of stationary buffers, each of said buffers including an element having an end face made of an abrasive material comprising rubber and a relatively soft abrasive; said mounting means being operatively attached to said housing and disposing said buffers on an associated common axis perpendicular to said travel path, said end faces of said buffer elements being disposed in confronting relationship to one another on opposite sides of said travel path.

11. The apparatus of claim 10 wherein said mounting means includes a support for each of said buffer elements and at least two mounting plates disposed within said housing on opposite sides of said travel path, each of said plates mounting said support for one buffer element of said pair, and wherein said apparatus additionally includes means for biasing said mounting plates toward one another.

12. The apparatus of claim 10 wherein there are at least four of said buffer pairs, said buffer pairs being spaced from one another along said travel path and being disposed on alternating, mutually perpendicular axes; and wherein there are at least two additional of said mounting plates so disposed and so mounting said supports, said additional plates being disposed on opposite sides of said travel path displaced about said travel path by 90° from said first-mentioned opposite sides thereof.

13. The apparatus of claim 10 wherein said abrasive is boron carbide.

14. The apparatus of claim 13 wherein said apparatus is a self-contained device adapted for installation into a system for the production of wire and the like, wherein said housing is elongated, wherein said end members are plates, and wherein said housing additionally includes a plurality of bars attached adjacent opposite ends thereof to said plates and extending therebetween to space said plate longitudinally from one another.

15. The apparatus of claim 10 wherein said buffer elements are of cubic form, and wherein said mounting means removably supports said buffer elements for selective positioning thereof.

16. A self-contained abrasive cleaning and polishing device adapted for installation into a system for the production of metal wire and the like, comprising a housing having means defining an axial travel path therethrough, mounting means, and at least four pairs of stationary buffers, each of said buffers including an element having a flat end face made of an abrasive material; said mounting means being operatively attached to said housing and disposing said buffers of each of said pairs on an associated common axis, said common axes being perpendicular to said travel path and spaced from one another therealong, and each of said common axes being perpendicular to each said common axis adjacent thereto, said mounting means including a support for each of said buffer elements and at least four mounting plates disposed within said housing at 90° intervals about said travel path, each of said plates mounting said support for one buffer element of two of said pairs, said end faces of said elements of each pair of buffers being disposed in confronting relationship to one another on opposite sides of said travel path; said housing having end members at the opposite ends thereof, each of said end members having a guide element therein for cooperatively defining the axis of movement of a workpiece along said travel path.

17. A system for the in-line processing of wire and the like, comprising: means for producing a continuous-length workpiece having a surface deposit thereon; means for continuously taking-up such a workpiece; and apparatus, interposed between said means for producing and said means for taking-up, for abrasive cleaning and polishing of the workpiece surface, said apparatus including a housing having means defining an axial travel path for the workpiece therethrough, mounting means, and at least two pairs of stationary buffers, each of said buffers including a removable element having a flat end face made of an abrasive material; said mounting means being operatively attached to said housing and disposing said buffers of each of said pairs on an associated common axis, said common axes being parallel to one another, perpendicular to said travel path, and spaced from one another therealong, said mounting means also being adapted to permit positioning of each of said buffer elements in either of at least two orientations rotated about said associated common axis, and including a support for each of said buffer elements and at least two mounting plates disposed within said housing on opposite sides of said travel path, each of said plates mounting said support for one buffer element of both of said pairs; said end faces of said elements of each pair of buffers lying substantially perpendicular to said associated common axis, and being disposed in confronting relationship to one another on opposite sides of said travel path; said housing having end members at the opposite ends thereof, each of said end members having a guide element therein for cooperatively defining the axis of movement of a workpiece along said travel path, said common axes being nonintersecting with said axis of movement so as to thereby cause said axis of movement to traverse said end face of each of said buffer elements along a line in on of said orientations thereof, which is different from the line traversed thereacross in the other of said buffer element orientations.

18. The system of claim 17 wherein said housing is elongated, wherein said end members are plates, and wherein said housing additionally includes a plurality of bars attached adjacent opposite ends thereof to said plates and extending therebetween to space said plates longitudinally from one another.

19. The system of claim 17 wherein said abrasive material of which said buffer elements are made comprises rubber and a relatively soft abrasive.

* * * * *